US009549630B2

(12) United States Patent
Hansen et al.

(10) Patent No.: US 9,549,630 B2
(45) Date of Patent: Jan. 24, 2017

(54) HANGER

(71) Applicant: Hangers Plus, LLC, Coopersville, MI (US)

(72) Inventors: James Hansen, Coopersville, MI (US); Russell O. Blanchard, Zeeland, MI (US)

(73) Assignee: Hangers Plus, LLC, Coopersville, MI (US)

( * ) Notice: Subject to any disclaimer, the term of this patent is extended or adjusted under 35 U.S.C. 154(b) by 0 days.

(21) Appl. No.: 14/864,661

(22) Filed: Sep. 24, 2015

(65) Prior Publication Data

US 2016/0088964 A1 Mar. 31, 2016

Related U.S. Application Data

(60) Provisional application No. 62/055,812, filed on Sep. 26, 2014.

(51) Int. Cl.

| | |
|---|---|
| ***A41D 27/22*** | (2006.01) |
| ***A47G 25/40*** | (2006.01) |
| ***A47G 25/32*** | (2006.01) |

(52) U.S. Cl.

CPC ..... *A47G 25/40* (2013.01); *A47G 25/32* (2013.01); *A47G 25/4015* (2013.01)

(58) Field of Classification Search

CPC ..... A47G 25/32; A47G 25/325; A47G 25/40
USPC ..... 223/85, DIG. 4
See application file for complete search history.

(56) References Cited

U.S. PATENT DOCUMENTS

| | | | | |
|---|---|---|---|---|
| 3,790,046 | A * | 2/1974 | Rooney | A47G 25/50 223/92 |
| 3,963,154 | A * | 6/1976 | Schwartz | A47G 25/32 223/85 |
| 4,168,791 | A * | 9/1979 | Clark, Jr. | A47G 25/50 223/94 |
| 4,221,298 | A | 9/1980 | Wright et al. | |
| 5,074,445 | A * | 12/1991 | Chen | A47G 25/32 211/116 |
| 5,085,357 | A * | 2/1992 | Chen | A47G 25/4038 223/85 |
| 5,163,590 | A * | 11/1992 | Lawler | A47G 25/16 223/69 |
| 5,649,652 | A * | 7/1997 | Sackett | A47G 25/32 223/85 |
| 7,837,074 | B2 | 11/2010 | Rude et al. | |

(Continued)

*Primary Examiner* — Nathan Durham
(74) *Attorney, Agent, or Firm* — The Watson I.P. Group, PLC; Jovan N. Jovanovic; Vladan M. Vasiljevic

(57) ABSTRACT

A hanger including a hanger body, a hook assembly and an attachment assembly. The hanger includes a hanger body and a hook assembly. The hook assembly includes a body and a hook member. The attachment assembly is structurally configured to couple the hook assembly to the hanger body while facilitating relative rotation thereof, and, comprises a first coupling component and a second coupling component. The first coupling component includes a central post having an outer surface and locking tabs at a distal end thereof. The second coupling component has a central bore with a rear annular surface. The central post extends through the central bore, with the locking tabs interfacing with the rear annular surface so as to substantially preclude axial movement of the central post within the central bore, while allowing rotation about an axis that extends through the central post.

16 Claims, 13 Drawing Sheets

(56) References Cited

U.S. PATENT DOCUMENTS

| | | | | |
|---|---|---|---|---|
| 8,113,393 | B2 | 2/2012 | Ho | |
| 9,113,736 | B1 * | 8/2015 | Antler | A47G 25/32 |

* cited by examiner

HANGER

CROSS-REFERENCE TO RELATED APPLICATION

This application claims priority from U.S. Provisional Patent Application Ser. No. 62/055,812 filed Sep. 26, 2014, entitled "Garment Hanger With Articulating Hook Assembly," the entire specification of which is hereby incorporated by reference in its entirety.

BACKGROUND OF THE DISCLOSURE

1. Field of the Disclosure

The disclosure relates in general to garment hangers, and more particularly, to a hanger that includes a hanger body and a hook assembly. The hook assembly is rotatable relative to the hanger body from a collapsed orientation to an articulated configuration. In the collapsed orientation the hook assembly overlies the hanger body so as to substantially minimally protrude. Such a configuration is well suited for shipping and the like. Additionally, the hook assembly may have the function of a sizer.

2. Background Art

The use of garment hangers is known in the art. Typically, garment hangers include a body assembly and a hook assembly. The hook assembly extends away from the body assembly. A sizer may be coupled to the hook assembly or to the body assembly. Such a hanger is known in the art.

Problematically, such hangers are difficult to ship as the hook member requires a packaging that is typically larger than would otherwise be necessary. In addition, when a sizer is coupled to the hanger, the hanger is complicated to reuse or recycle. That is, the configuration does not lend itself to reuse, shipment, recycling, etc.

It would be desirable to overcome those problems set forth above, as well as to provide additional utility through a garment hanger that includes an articulating hook assembly.

SUMMARY OF THE DISCLOSURE

The disclosure is directed to a hanger comprising a hanger body, a hook assembly and an attachment assembly. The hanger includes a hanger body and a hook assembly. The hanger body includes a first face and a second face opposite the first face. The hanger body extends from a first end to a second end. The hook assembly includes a body with an outward side and an inward side opposite the outward side. And, a hook member extends from the body and terminates at an end tip. The attachment assembly is structurally configured to couple the hook assembly to the hanger body while facilitating relative rotation thereof. The attachment assembly comprises a first coupling component and a second coupling component. The first coupling component extends from one of the hanger body and the hook assembly. The first coupling component includes a central post having an outer surface and locking tabs at a distal end thereof. The second coupling component is associated with the other of the hanger body and the hook assembly from the first coupling component. The second coupling component has a central bore with a rear annular surface. The central post extends through the central bore, with the locking tabs interfacing with the rear annular surface so as to substantially preclude axial movement of the central post within the central bore, while allowing rotation about an axis that extends through the central post.

In some configurations, the second coupling component further includes a first side outer ring extending about the central bore, and a raised projection extending outwardly from the first side outer ring. The first coupling component further includes a guide slot portion having a first end stop and a second end stop. The raised projection extends into the guide slot portion and is positionable therealong between the first end stop and the second end stop. Positioning of the raised projection at the first end stop defines the collapsed orientation of the hook assembly relative to the hanger body and the second end stop defines the articulated orientation of the hook assembly relative to the hanger body.

In some configurations, the first coupling component further includes a first detent positioned proximate the first end stop and a second detent positioned proximate the second end stop. The raised projection further includes an indent configured to structurally engage the first end stop when in a collapsed orientation and the second end stop when in an articulated orientation to releasably lock the hook assembly relative to the hanger assembly, and, to, in turn, preclude relative rotation therebetween.

In some configurations, the guide slot portion comprises an arcuate member spaced apart from the central post.

In some configurations, the guide slot comprises an arcuate member having a center of curvature that is concentric with the central post.

In some configurations, the first coupling component includes an outer rim axially spaced apart from the central post. The guide slot portion is defined by an inner surface thereof. The first end stop and the second end stop extend axially inward therefrom. A channel is defined between the central post and the outer rim.

In some configurations, the central post further comprises opposing fixed portions with a beam spanning therebetween. Each of the opposing fixed portions defining a portion of the outer surface. Opposing flexible posts extend between the opposing fixed portions. The locking tabs extend from distal ends of the opposing flexible posts. The flexible posts defining a portion of the outer surface.

In some configurations, the opposing fixed portions and the beam spanning therebetween define an I-beam with opposing cavities. The cavities are positioned proximate the opposing flexible posts, to in turn, allow for inward flexion of the opposing flexible posts into the opposing cavities.

In some configurations, the first coupling component is associated with the hook assembly and the second coupling component is associated with the hanger body.

In some configurations, the central post extends from the inward side of the body of the hook assembly.

In some configurations, the central post is perpendicular to the inward side of the body.

In some configurations, the body of the hook assembly further includes an upper boss portion. The upper boss portion having indicia corresponding to a size of a garment coupled to the hanger.

In some configurations, the central bore includes a rounded first end structurally configured to urge the central post into position to extend therethrough.

In some configurations, the second coupling component further comprises a second side barrier portion positioned axially spaced apart from the rear annular surface of the central bore. The second side barrier portion defines a cavity. The locking tabs are maintained within the cavity.

In some configurations, the body and the hook member are integrally molded.

In some configurations, the body and the hook member comprise different materials.

In some configurations, the central bore is substantially circular in cross section. The outer surface has a substantially circular cross sectional configuration that substantially corresponds to the central bore.

BRIEF DESCRIPTION OF THE DRAWINGS

The disclosure will now be described with reference to the drawings wherein.

DETAILED DESCRIPTION OF THE DISCLOSURE

Figure 1:
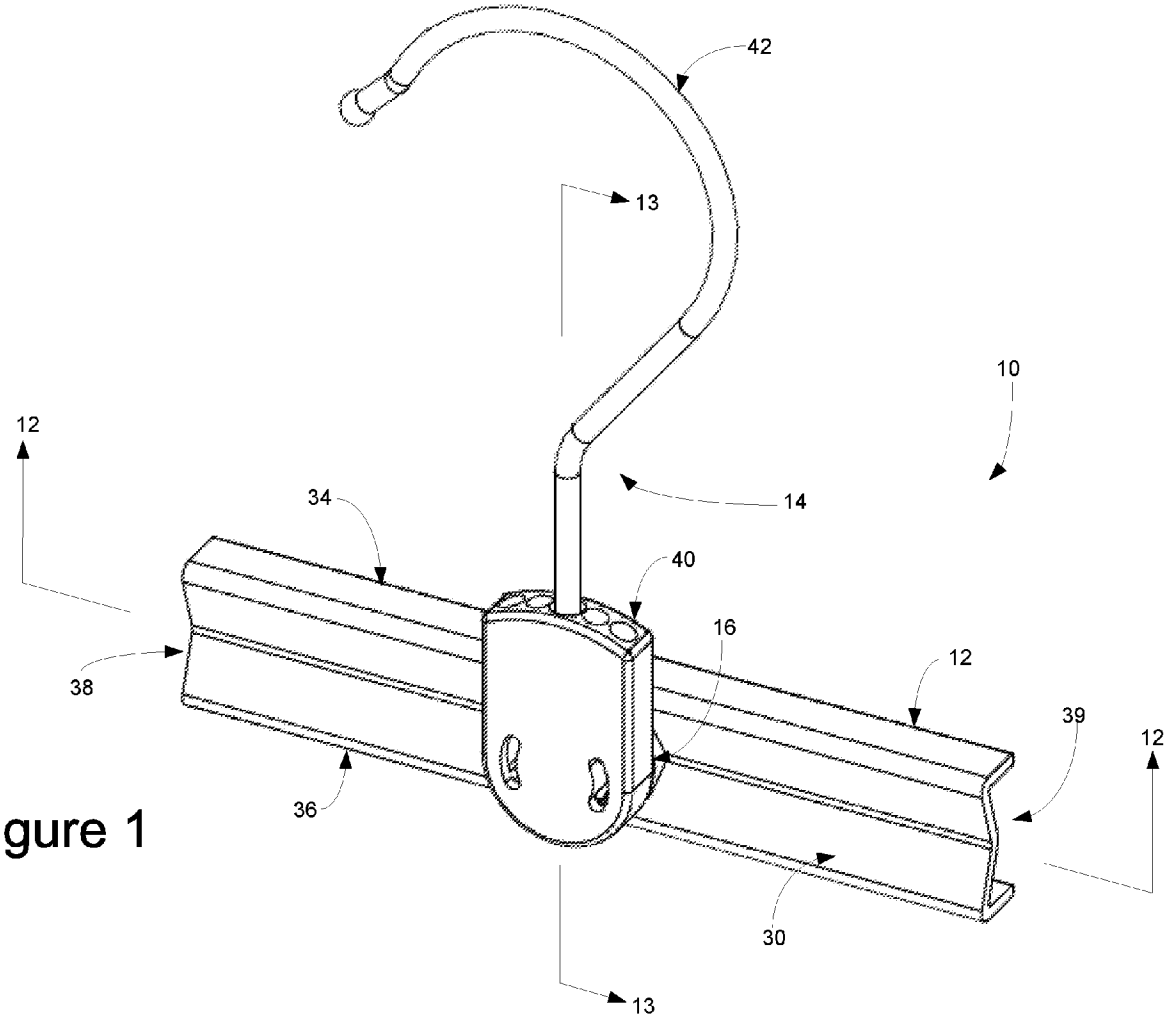
FIG. 1 of the drawings is a front perspective view of a configuration of the hanger of the present disclosure, showing, in particular, the articulated configuration.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIGS. 1 through 4, collectively, the hanger of the present disclosure is shown generally at 10. It will be understood and explained below that the hanger 10 comprises hanger body 12, hook assembly 14 and attachment assembly 16. The hanger, it will be understood, may have additional structures (not shown) for engaging various clothing portions, including but not limited to clips, clasps, frictional clothing engagement fingers, spaghetti strap retaining openings. Some such structures are shown in U.S. Pat. Nos. 7,506,785 and 7,464,841, both of which are issued to Hansen, et al, both of which are incorporated herein in their entirety by reference, as well as the patents cited therein. Generally, the hanger is configured for collapsing and articulating the hook from a stowed orientation to a deployed orientation. Such a hanger is well suited for shipping. Additionally, the components can be shipped separately and assembled as desired at locations remote of the manufacture thereof. Furthermore, the hook assembly may integrally include or have the additional function of a garment sizer.

The hanger body 12 is shown to be of the type commonly referred to as a lowers hanger or a beam hanger. It will be understood that the principles can be applied to uppers hangers and the like, and the disclosure is not limited to a lowers hanger or to a hanger having a beam construction, much less a beam having a particular cross-sectional configuration.

In the configuration shown in FIGS. 1 through 4, and with reference in greater detail to FIGS. 5 through 8, the hanger body includes first face 30, second face 32, top end 34 and bottom end 36. The configuration shown has a generally "M" shaped beam having a substantially uniform cross-sectional configuration between the first side 38 and the second side 39. In other configurations, other cross-sectional configurations are contemplated, as well as shapes that vary in cross-sectional configuration between the first side and the second side. Furthermore, in the configuration shown, the first face comprises the outward face and the second face comprises the inward face (i.e., the hanging hanger has the first face exposed to the consumer). Other configuration are likewise contemplated wherein the second face comprises the outward face, with the first face being the inward face. In still other configurations, additional faces may be present with thicker constructions and the like.

In the configuration shown, the first face comprises a concave configuration that is symmetrical about a bisecting line between the top end 34 and the bottom end 36. The second face is convex with concave portions near the top end 34 and the bottom end 36 due to outwardly extending flanges.

Figure 9:
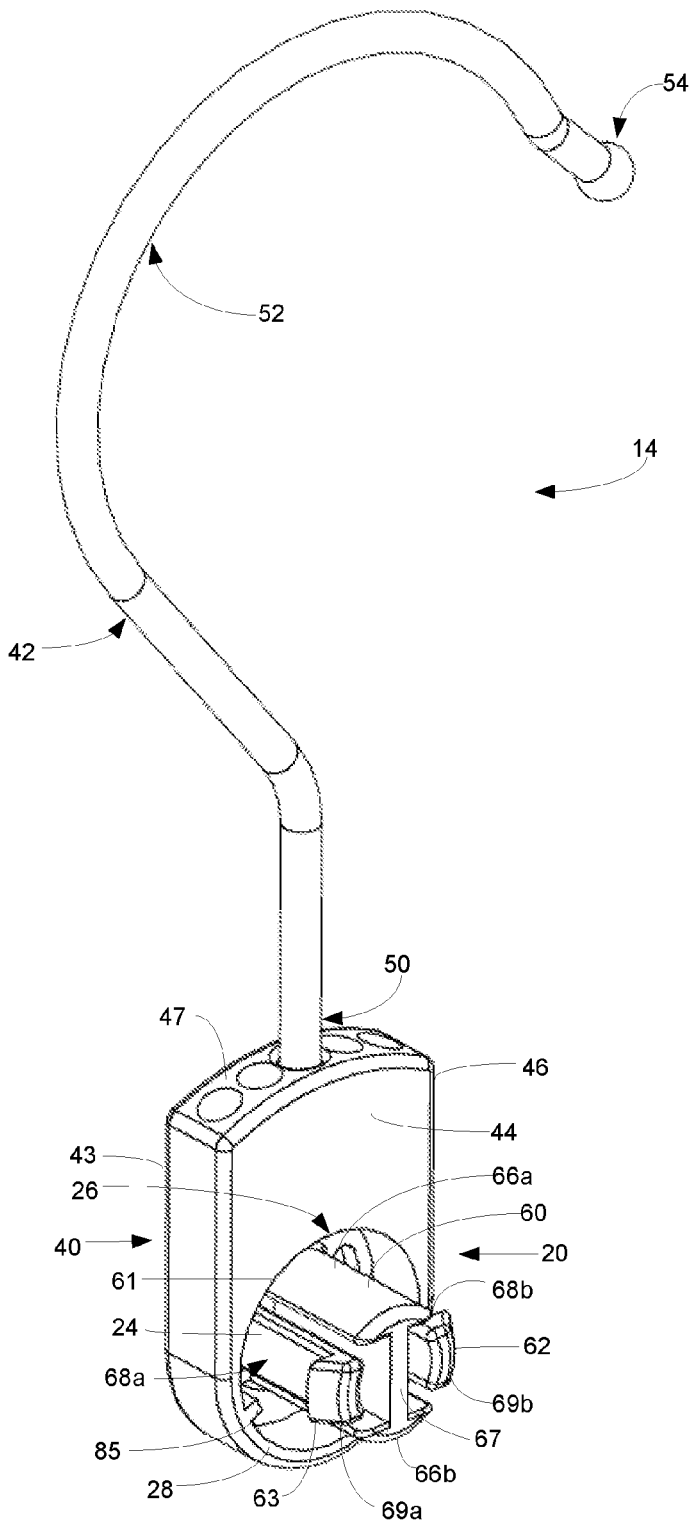
FIG. 9 of the drawings is a back perspective view of the hook assembly of the present disclosure, showing, in particular, the first coupling component of the attachment assembly.
Figure 10:
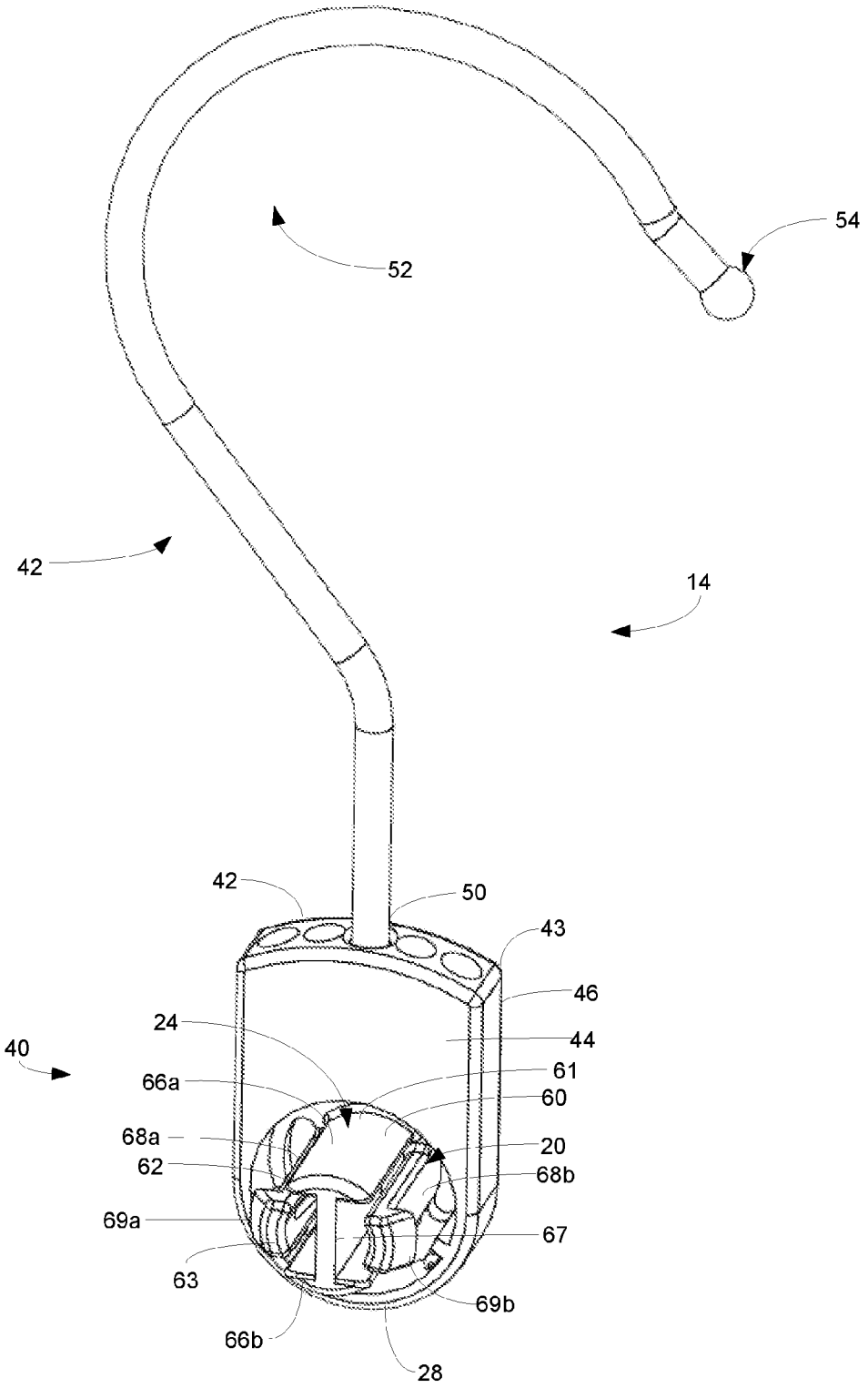
FIG. 10 of the drawings is a back perspective view of the hook assembly of the present disclosure, showing, in particular, the first coupling component of the attachment assembly.
Figure 11:
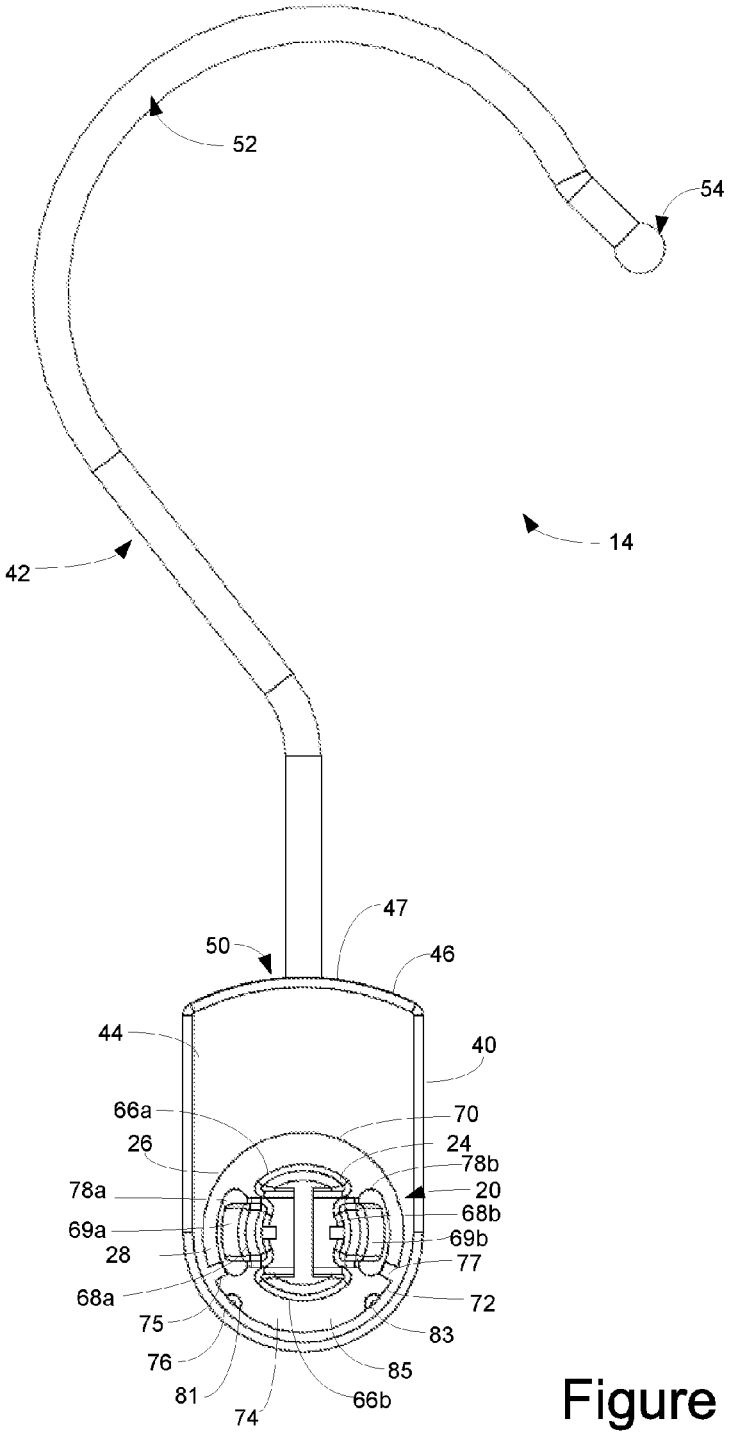
FIG. 11 of the drawings is a back elevational view of the hook assembly of the present disclosure, showing, in particular, the first coupling component of the attachment assembly.

The hook assembly 14 is shown in greater detail in FIGS. 9 through 11 as comprising body 40 and hook member 42. The body 40 generally comprises a molded polymer member, however other materials are likewise contemplated. The body includes outward side 43, inward side 44 which cooperatively define the upper boss portion 46, and terminate at top end 47. The boss portion may form a sizer, wherein indicia is applied to one or both of the outward side and the inward side that references the size of the garment (i.e., S, M, XL, a number such as 12, 14, 16, 36, 38, 40, among others). The outward side and the inward side are typically defined by a perimeter, which in the configuration shown is a generally substantially uniform thickness. Depending on the particular configuration, the perimeter, or thickness between the outward side and the inward side may allow for indicia along the thickness therebetween. It will further be understood that while the outward side and the inward side are shown as being substantially planar, other configurations are contemplated, such as, for example, configurations wherein the sides may have surface variations, which results in varying thicknesses for the body.

Figure 16:
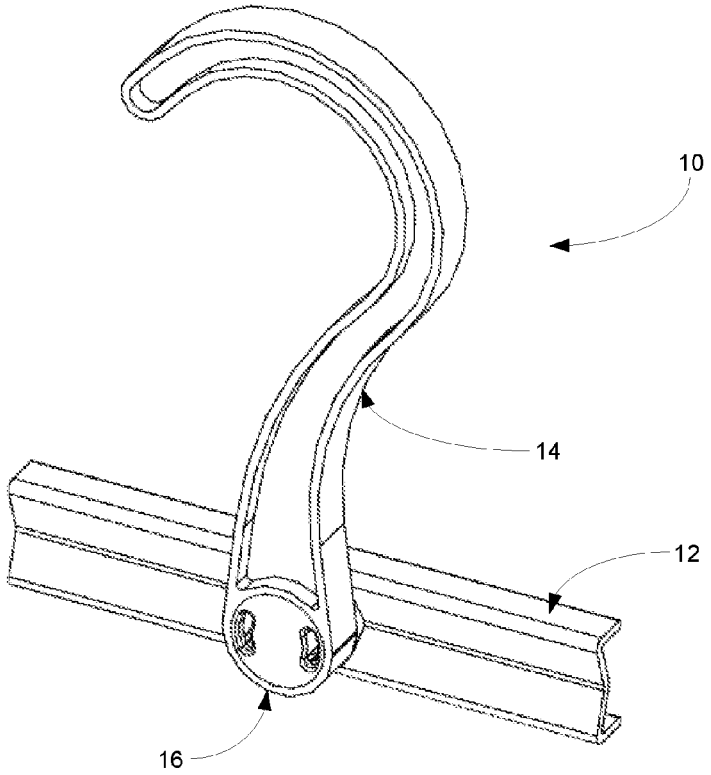
FIG. 16 of the drawings is a front perspective view of a hanger in the articulated configuration, wherein the hook assembly body and hook member are integrally molded.
Figure 17:
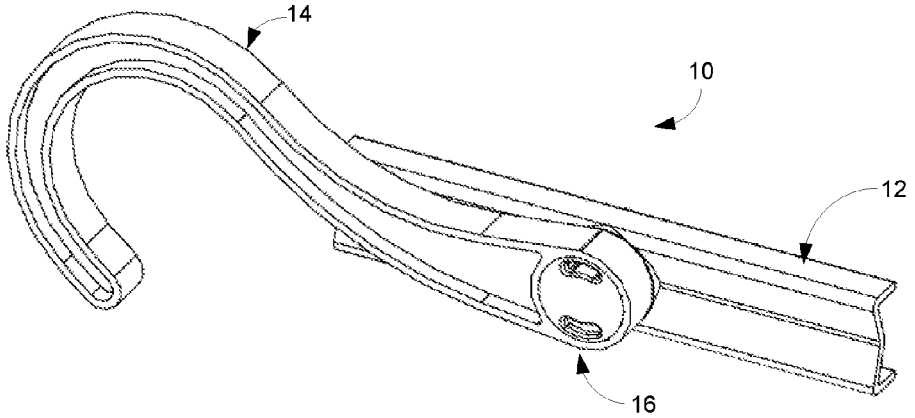
FIG. 17 of the drawings is a front perspective view of a hanger in the collapsed configuration, wherein the hook assembly body and hook member are integrally molded.

The hook member 42 extends from the top end 47 of the body 40 and includes lower end 50, upper curved portion 52 and end tip 54. In the configuration shown, the hook member comprises a metal member of a substantially uniform diameter that is shaped into the configuration shown. Generally, the curved portion is configured to extend around a pole or other elongated member, and variations in shape are contemplated. In many such embodiments, the end tip may include an additional formation, such as, for example a sphere or a bent portion or the like. In other configurations, such as the configuration shown in FIGS. 16 and 17, the hook member may be integrally formed with the body 40 and may likewise comprise a polymer member. In such a configuration, typically, the hook member may comprise an I-beam construction or the like. In other configurations, the hook member may comprise a cylindrical cross-section, a square cross section or another shape.

The attachment assembly 16 is shown as comprising first coupling component 20 (FIG. 9 through 11) and second coupling component 22 (FIG. 5 through 8). In the configuration shown, the first coupling component is formed on the hook assembly and the second coupling component is formed on the hanger body. It will be understood that in other configurations, the first coupling component may be formed on the hanger body with the second coupling component being formed on the hook assembly.

The first coupling component is shown as comprising central post 24, outer rim 26, and channel 28. It will be understood that the central post forms the axis and the surface about which the hook assembly rotates relative to the hanger body (in cooperation with the central bore of the second coupling component). The central post 24 includes outer surface 60, proximal end 61, distal end 62 and locking tabs 63. In the configuration shown, the central post is generally substantially perpendicular to the body 40 of the hook assembly 14. It will be understood that in certain configurations, generally, the body 40 may have variations, however, the central post is configured such that the hook assembly can be positioned so as to overlie the hanger body (and in the configuration shown, the first face thereof) when in a collapsed configuration.

The outer surface is defined by a pair of opposing fixed portions 66*a*, 66*b* and opposing flexible posts 68*a*, 68*b*. The opposed fixed portions have an outer arcuate configuration and are generally mirror images thereof. The outer arcuate configurations have matching radii of curvature and corresponding central points of rotation. In the configuration shown, the two opposing fixed portions extend for approximately 30° of rotation. It is contemplated that these may comprise between 15° and 160° of rotation, although both greater and smaller are contemplated. It is additionally contemplated that the opposing fixed portions may vary relative to each other, and that they may be other than symmetrical relative to each other.

In the configuration shown, beam 67 spans between the opposing fixed portions 66*a*, 66*b*. It will be understood that the beam provides additional support to the opposing fixed portions so as to limit the movement thereof. In the configuration shown, the beam extends from the center of each of the opposing fixed portions and through the central axis of rotation of the central post, and defines opposing cavities on either side thereof along with the inner surfaces of the opposing fixed portions.

The opposing flexible posts 68*a*, 68*b* extend on opposing sides of the central beam and have the ability to be forced inward toward the beam 67 and into the cavity formed by the beam and by each of the opposing fixed portions. In the configuration shown, the opposing flexible posts are mounted 180° apart and the fixed portions are positioned 180° apart so that the configuration of the outer surface alternates between the flexible posts and the fixed portions every 90°. Of course, variations are contemplated.

The opposing flexible portions are defined by elongated leg like members and each include an interfacing portion at the distal end thereof. The interfacing portion, in the configuration shown comprises opposing outward locking tabs 69*a*, 69*b*. The locking tabs have a configuration that includes an inclined upper surface and a lower surface that is substantially perpendicular to the leg member, so as to define a substantially triangular cross sectional configuration. As such, upon insertion of the central post, the inclined upper surface directs the legs inwardly allowing insertion; however, when expanded, a force against the lower surface does not translate into inward movement (that is, the inclined portion directs at least a portion of force applied thereto inwardly) whereas a force directed at the lower surface does not have an inward component (although a tremendous force may inwardly move the lower surface due to a movement arm that forms as a result of the force).

It will be understood that openings, such as the openings 78*a*, 78*b* may extend through the hanger body inboard of the opposing flexible portions 68*a*, 68*b*. Such openings provide both access to the central post region, and also provide additional flexion to the opposing flexible portions relative to the hook assembly. In the configuration shown, the openings are kidney bean like in formation and the arcuate surfaces thereof are centered about the axis of rotation of the device.

The outer rim 26 of the first coupling component 20 is shown as comprising inner surface 70 which extends from the inward side of the body 40 of the hook assembly and terminates at the upper rim 72. In the configuration shown, the outer rim and the central post are concentric and substantially cylindrical in configuration and define channel 28 therebetween. The channel 28 includes base surface 85 that extends between the central post and the outer rim.

The guide slot portion 74 is defined within the channel 28. Essentially, the guide slot portion provides a slot along which the raised projection 100 can travel along. In the configuration shown, the guide slot portion extends approximately so as to allow the hook assembly and the hanger body to rotate through approximately 90° (while variations in the arcuate travel are contemplated). As can be seen in FIGS. 12 through 15, based on the position and configuration of the raised projection, the guide slot portion extends from first end stop 75 and second end stop 77. It will be understood that in the configuration shown, the raised projection 100 can travel between the first end stop 75 and the second end stop 77. The two stops extend inwardly from the inner surface of the outer rim. It will be understood that the raised projection may also travel along the inner surface 70 of the outer rim. It will further be understood that a projection may be positioned on the outer rim, or within the channel 28, and the corresponding guide slot portion may be disposed on the hanger body.

Additionally, in the configuration shown, the releasable position locking members 76 are positioned along the first coupling component, and in the configuration shown, as extending inwardly from the inner surface of the outer rim and along the guide slot portion. In such a configuration, the releasable position locking members comprise first detent 81 and second detent 83 which are configured to engage the indentation 104 on the outer portion 102 of the raised projection (as will be explained below). It will be understood that the detent may be on the second coupling component with the indentation on the first coupling component.

The second coupling component 22 is shown in FIGS. 5 through 8 as comprising central bore 90, first side outer ring 91 and second side barrier portion 92. In the configuration shown, the second coupling component is shown as being formed on the hanger body. As discussed above, the second coupling component may be formed on the hook assembly with the first coupling component being formed on the hanger body. The second coupling component, as will be explained, is coupled to the first coupling component to allow for relative rotation therebetween.

The central bore includes first end 94 and second end 95. In the configuration shown, the first end includes a rounded configuration to direct the first coupling component properly into the central bore, especially wherein the two are slightly offset. The rear annular surface 96 is generally planar with the first side outer ring so as to provide a surface which engages the outward locking tabs 69*a*, 69*b* of the opposing flexible posts. It will be understood that a structure may be placed on the rear annular surface so as to limit the relative rotation by interfacing with the outward locking tabs 69*a*, 69*b*.

Figure 14:
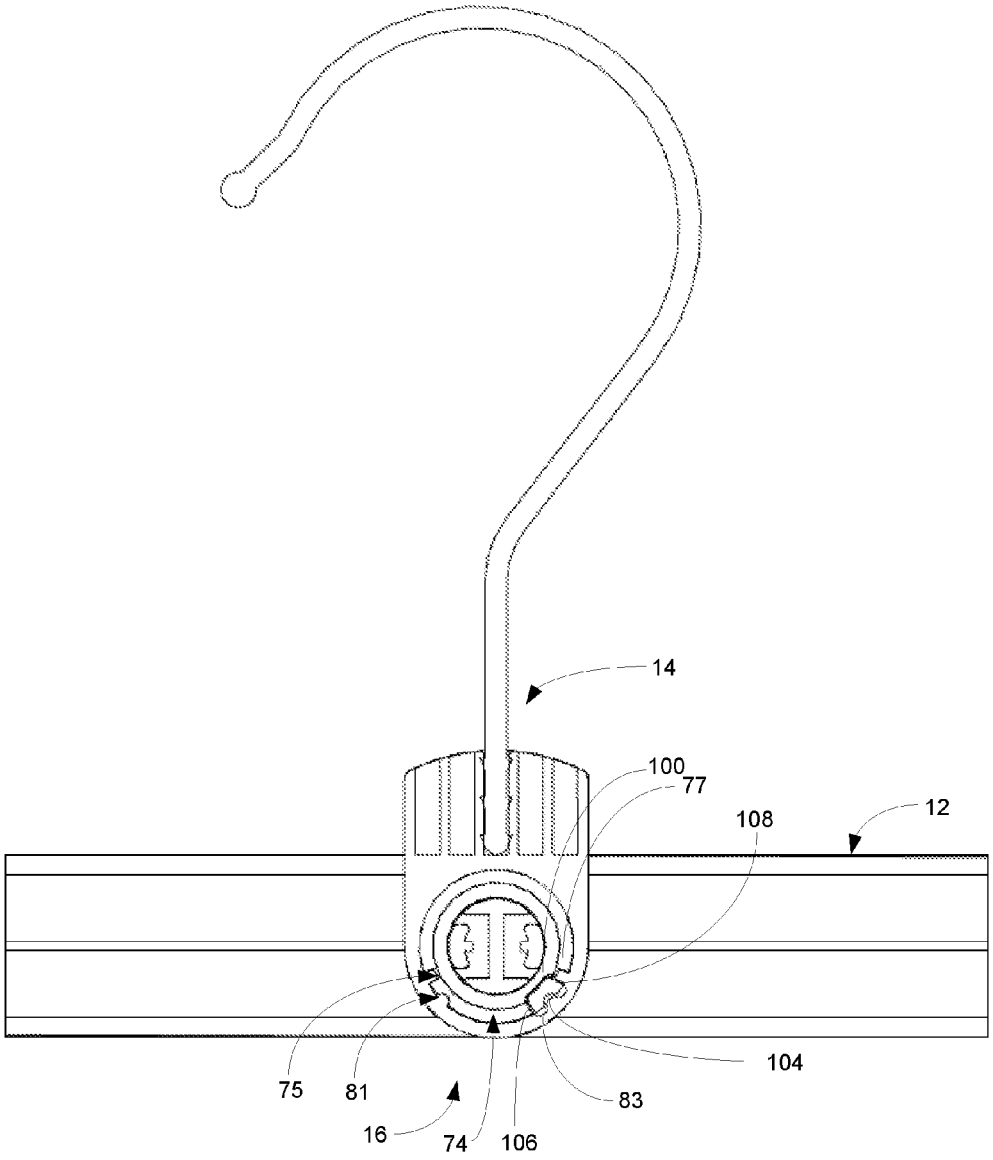
FIG. 14 of the drawings is a cross-sectional view of the hanger in the articulated configuration, showing, the interfacing of the raised projection with the guide slot portion.
Figure 15:
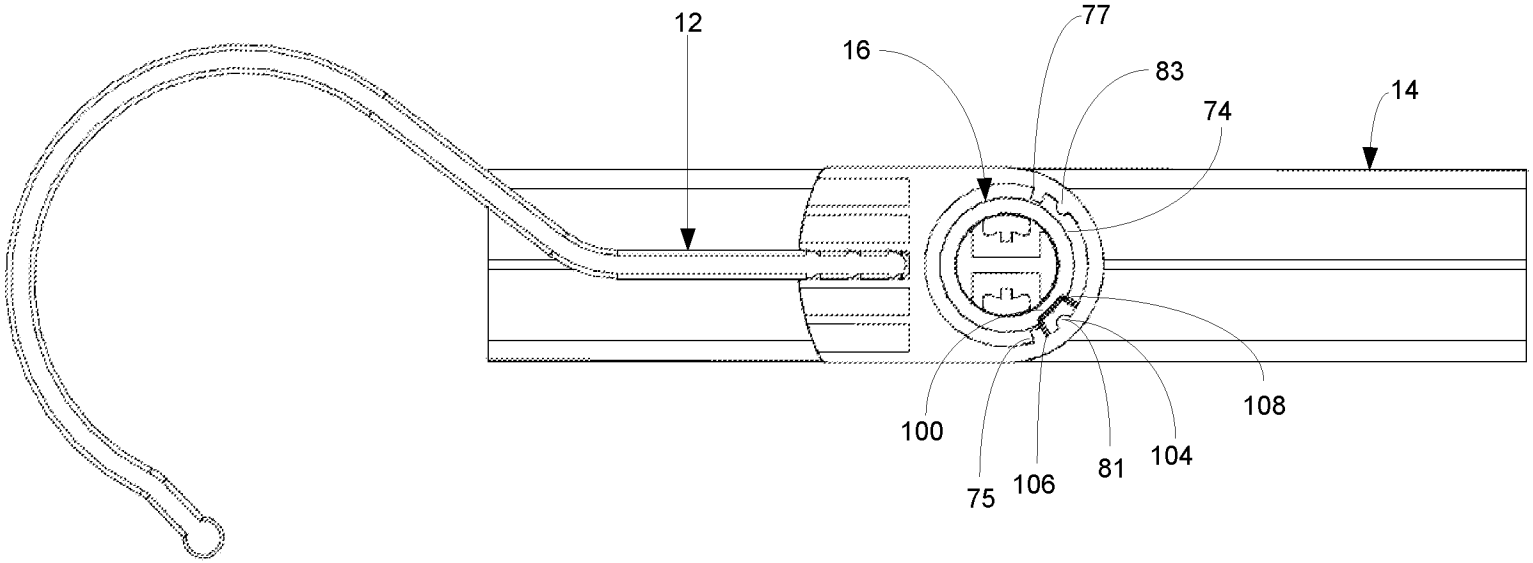
FIG. 15 of the drawings is a cross-sectional view of the hanger in the collapsed configuration, showing, the interfacing of the raised projection with the guide slot portion.

The first side outer ring includes a substantially planar surface that includes a raised projection 100 extending therefrom. The raised projection 100 includes outer portion 102, first side 106 and second side 108. As will be explained, below, and with reference to FIGS. 14 and 15, the first side 106 interfaces with the first end stop 75 of the guide slot portion. The second side 108 interfaces with the second end stop 77 of the guide slot portion. The outer portion 102 interfaces with the inner surface 70 of the outer rim 26 (either directly, or spaced apart therefrom), with the first and second detents 81, 83 configured to be releasably positionable within the indent 104 of the raised projection. In other configurations, it will be understood that the detent may be positionable on the raised projection with the indent on the outer rim.

The second side barrier portion 92 comprises an outer ring that is spaced apart (but, in the configuration shown, concentric with) the central bore. The second side barrier portion extends beyond the rear annular surface and beyond the outward locking tabs 69*a*, 69*b*, so as to provide protection for each of them. Due to the spacing, an inner cavity is created between the central bore and the second side barrier portion. In turn, the outward locking tabs can extend into this cavity and are generally protected from being inadvertently hit, dislodged or otherwise undesirably contacted.

To assemble the hanger of the present disclosure, a hook assembly is first provided. Typically, the hook assembly will be provided with both a body and a hook member coupled to the body. In some configurations, the two components may be integrally formed, whereas in other configurations, they may be separate items, and may be separately attachable to each other. In some configurations, the hanger body is molded over the hook member. In other configurations, the hook member is inserted into the body after formation, and, for example, at an elevated temperature. At the same time, the hanger body is provided. As indicated above, a number of different hanger body configurations are contemplated for a number of different applications. Often, the hanger body will comprise a lower garment hanger, however, the disclosure is not limited thereto.

Once both the hanger body and the hook assembly are provided, they can be joined together. In particular, in the configuration shown, the first coupling component extends outwardly away from the inward side 44 of the body 40 of the hook assembly 12. In the configuration shown, the central post extends generally perpendicular to the inward side of the body 40. Similarly, the second coupling component 22 is formed on the hanger body 12 and is generally perpendicular to the first and second faces thereof.

To assemble the components, the central post 24 is directed into the central bore 90. Initially, when the outwardly locking tabs 69*a*, 69*b* reach the first end 94 of the bore, the rounded surface thereof urges the locking tabs inwardly due to the contact with the inclined upper surface of the locking tabs. Continued movement inward through the central bore urges the locking tabs inwardly until they define a diameter that can fit through the central bore.

Figure 12:
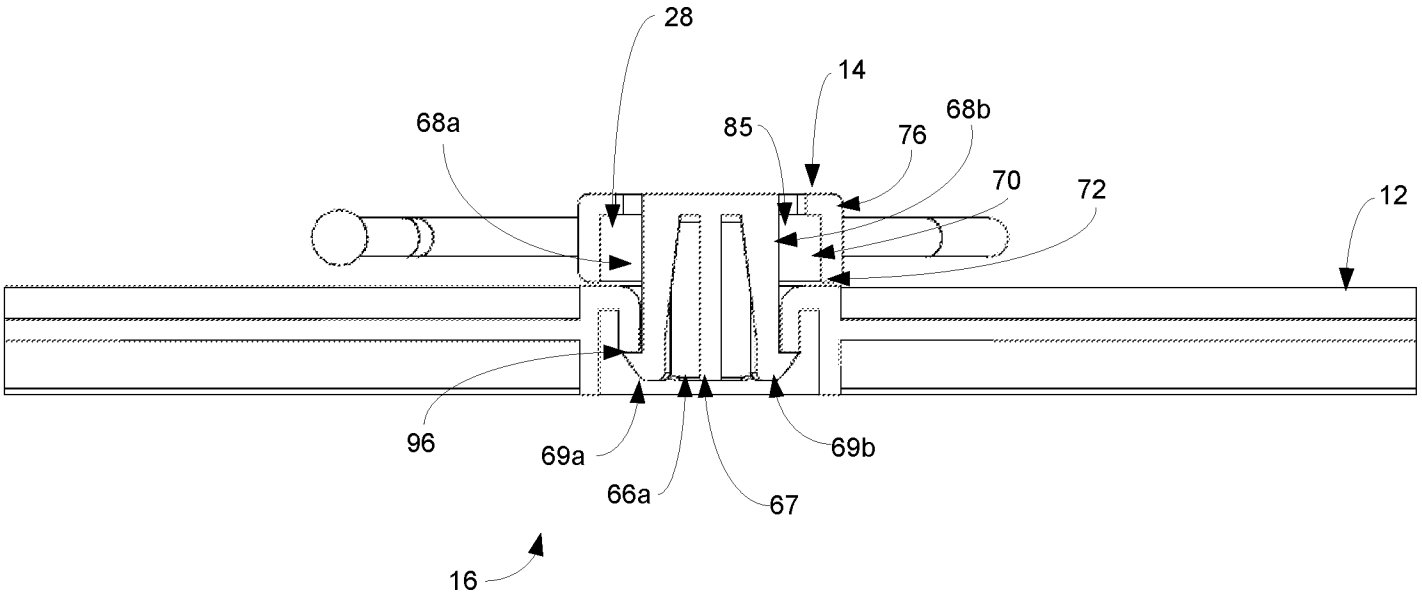
FIG. 12 of the drawings is a cross-sectional view of the hanger in the articulated configuration, taken generally about lines 12-12 of FIG. 1.
Figure 13:
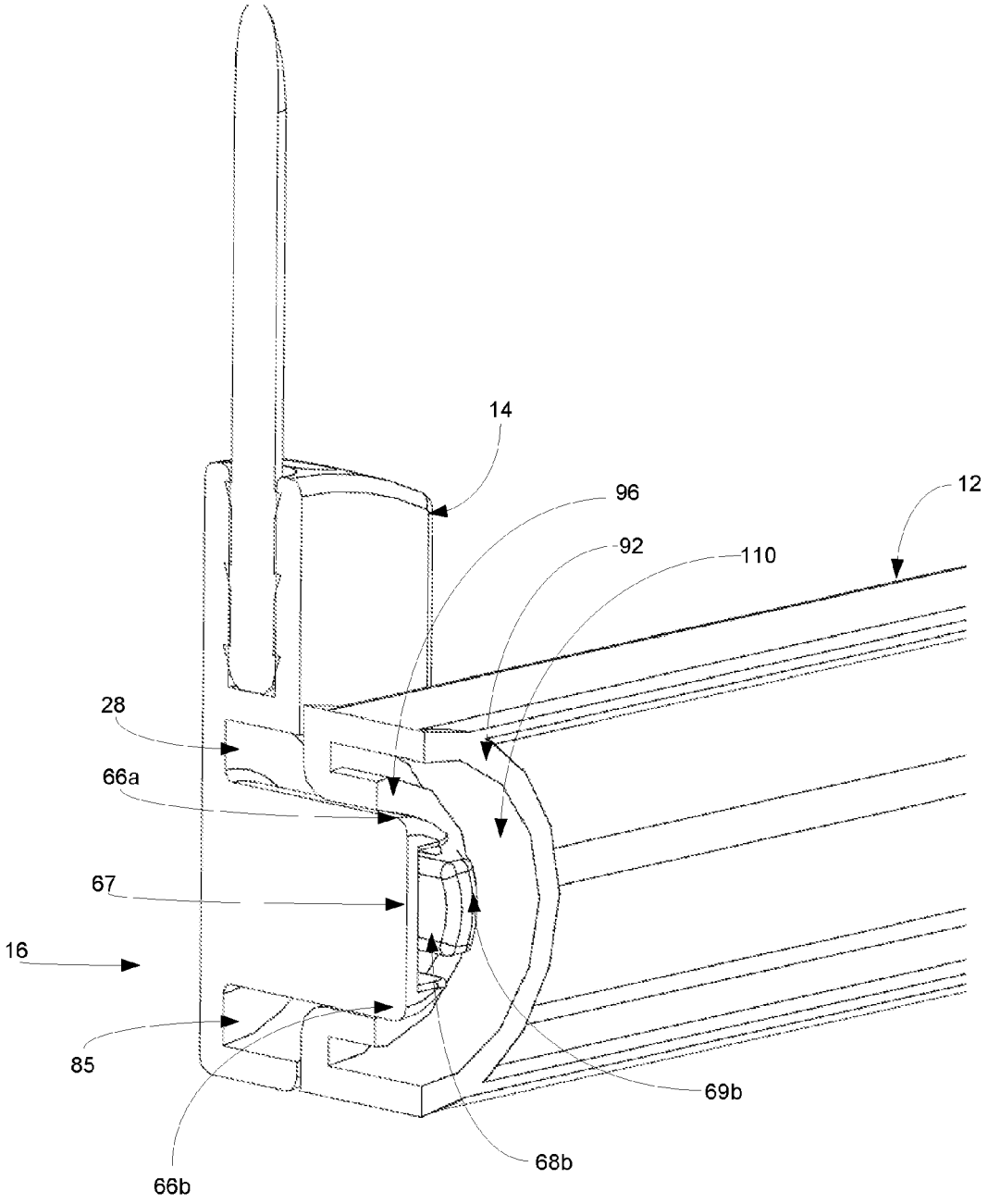
FIG. 13 of the drawings is a cross-sectional view of the hanger in the articulated configuration, taken generally about lines 13-13 of FIG. 1.

Eventually, and as is shown in FIGS. 12 and 13, the outward locking tabs 69*a*, 69*b* reach the second end 95 of the central bore and pass therethrough. At such time, with no force directing the outward locking tabs inwardly, the locking tabs (through the flexibility of the opposing posts) return to their original configuration. In the initial configuration, the outward locking tabs extend outwardly beyond the rear annular surface and the lower surfaces of the locking tabs engage the rear annular surface of the central bore. Due to the generally perpendicular configuration of the locking tabs relative to the posts (and the substantially parallel configuration thereof to the rear annular surface), the locking tabs preclude rearward movement of the central post back through the central bore.

Due to the shape of the central post, the central post is configured to rotate about an axis within the central bore. Generally, the outer surface of the central post will selectively contact with the central bore with the outward locking tabs cooperating with the inward side of the body of the hook assembly to preclude substantial axial movement and dislodging.

While the two are being coupled, the hook assembly is rotated relative to the hanger body so that the raised projection 100 of the second coupling component extends into the guide slot portion 74 of the outer rim of the first coupling component.

Figure 2:
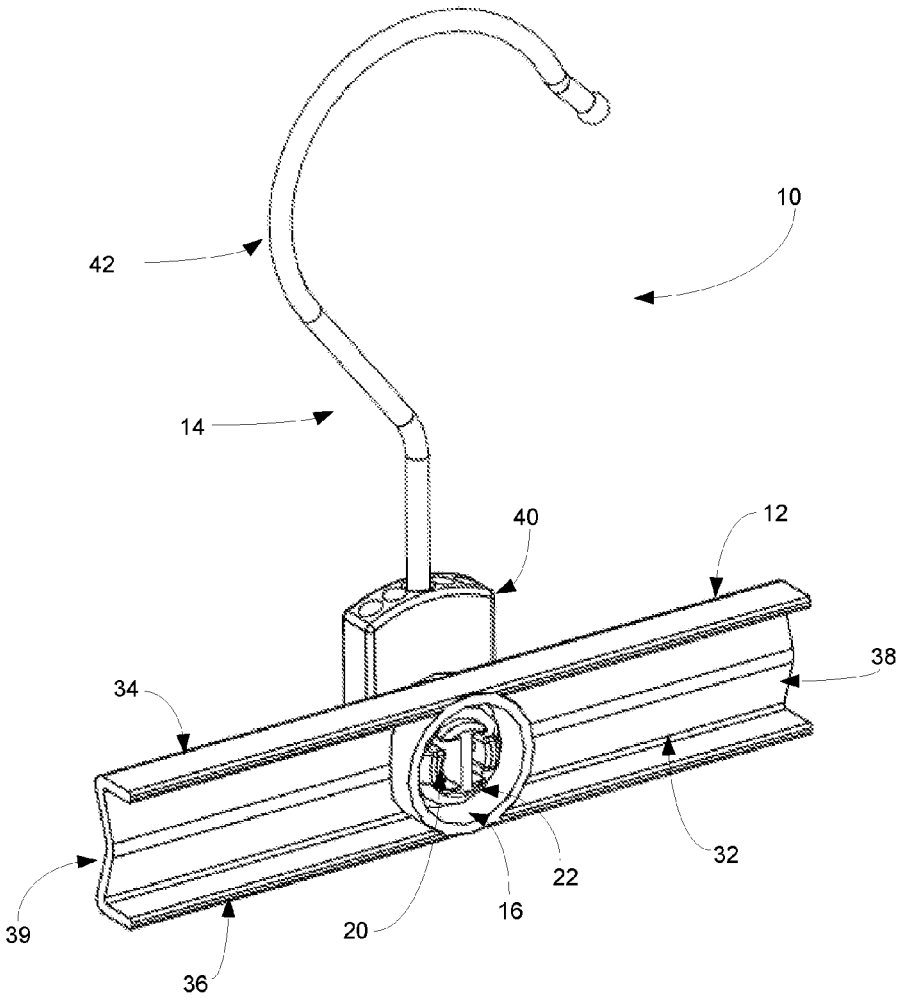
FIG. 2 of the drawings is a back perspective view of a configuration of the hanger of the present disclosure, showing, in particular, the articulated configuration.
Figure 3:
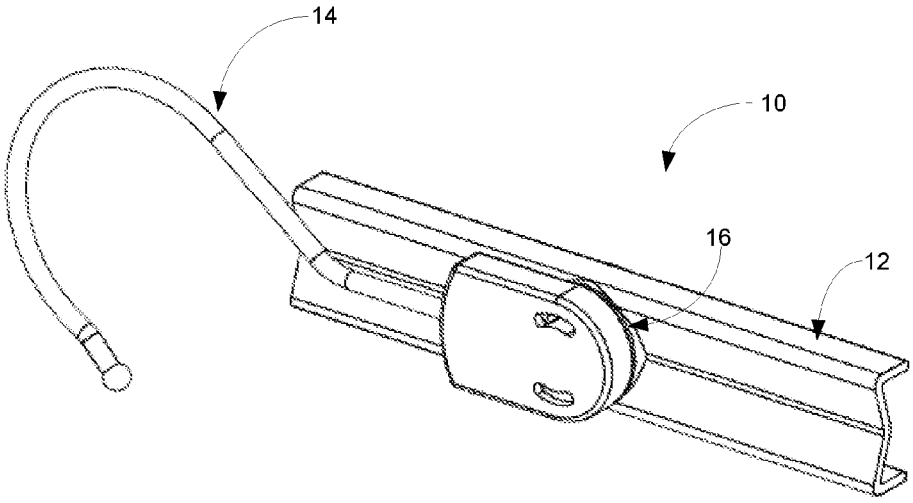
FIG. 3 of the drawings is a front perspective view of a configuration of the hanger of the present disclosure, showing, in particular, the collapsed configuration.
Figure 4:
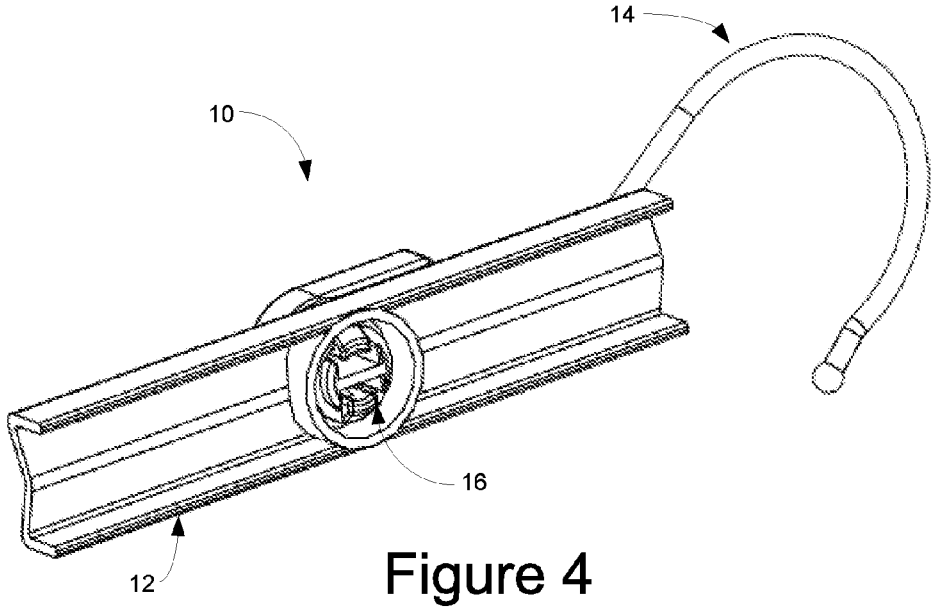
FIG. 4 of the drawings is a back perspective view of a configuration of the hanger of the present disclosure, showing, in particular, the collapsed configuration.
Figure 5:
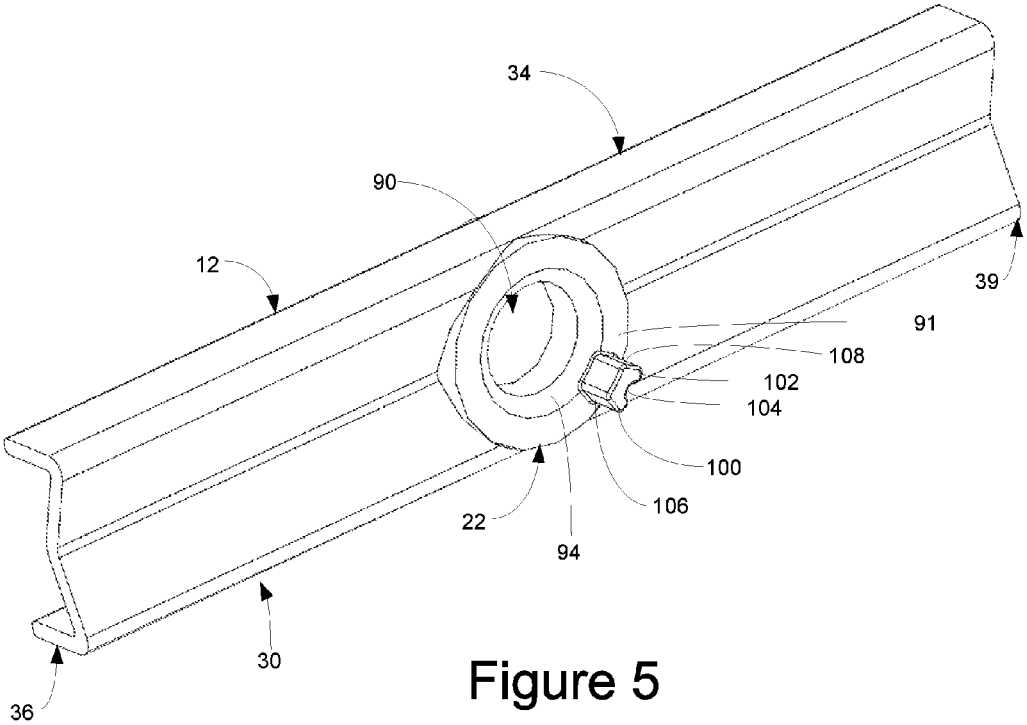
FIG. 5 of the drawings is a front perspective view of the hanger body, showing, in particular, the second coupling component of the attachment assembly.
Figure 6:
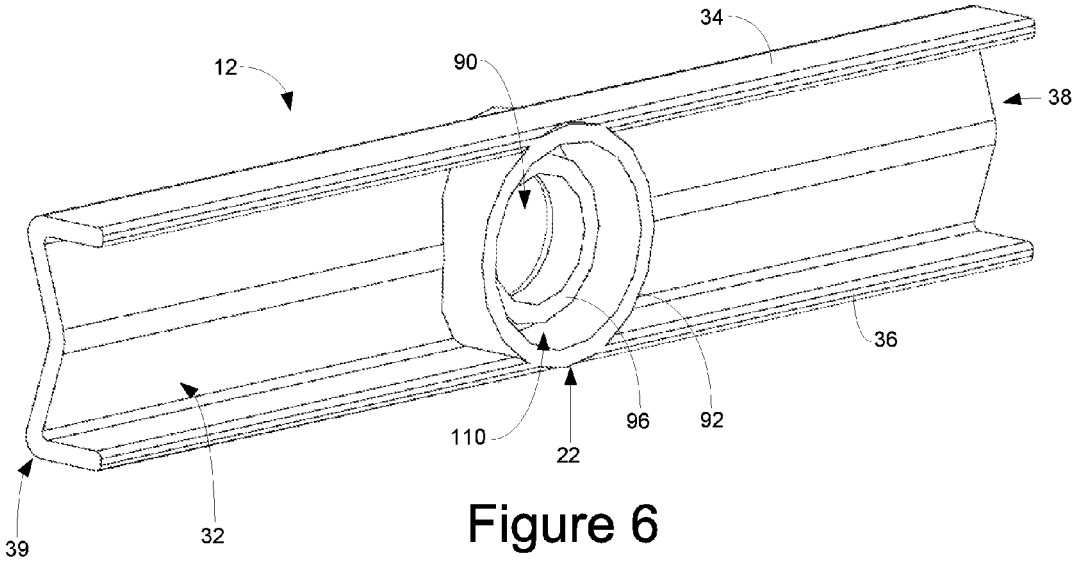
FIG. 6 of the drawings is a back perspective view of the hanger body, showing, in particular, the second coupling component of the attachment assembly.
Figure 7:
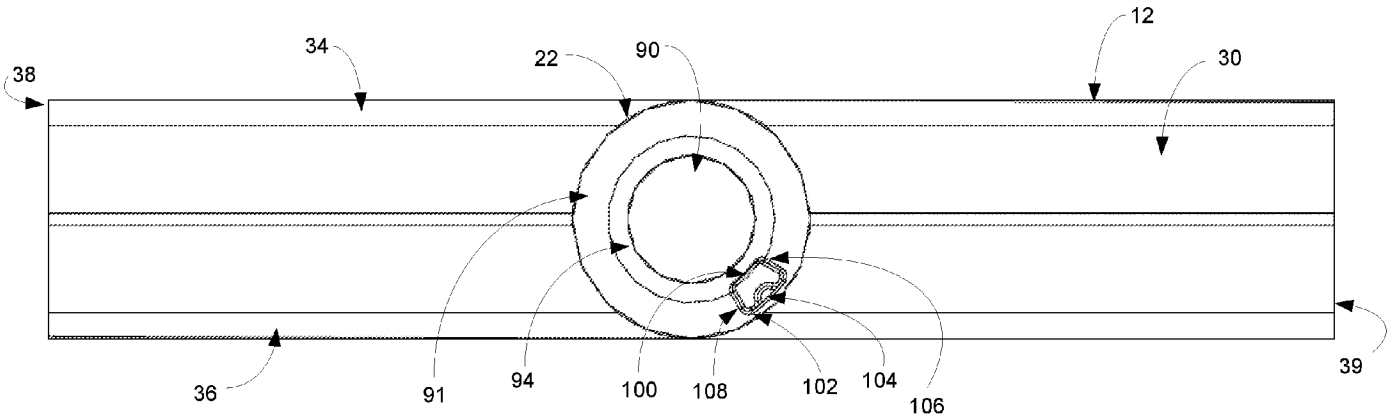
FIG. 7 of the drawings is a front elevational view of the hanger body of the present disclosure, showing, in particular, the second coupling component of the attachment assembly.
Figure 8:
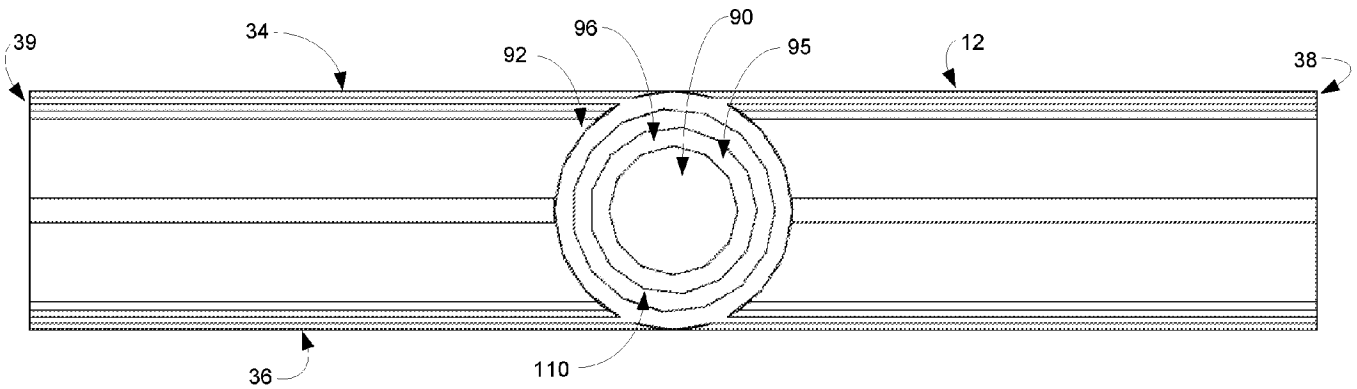
FIG. 8 of the drawings is a back elevational view of the hanger body of the present disclosure, showing, in particular, the second coupling component of the attachment assembly.

Once fully assembled the hanger can be articulated between the collapsed or stored orientation to a fully articulated configuration. In the collapsed orientation, the hook member overlies the hanger body. Such a configuration is shown in FIGS. 3 and 4. In the fully articulated configuration, the hook member extends above the hanger body and, typically, with the hook member extending substantially perpendicular to the hanger body (although full articulation may vary depending on the configuration of the hanger and the relative range of rotation). Such a configuration is shown in FIGS. 1 and 2.

Starting in the collapsed configuration, the first side 106 of the raised projection 100 is position proximate (or one of resting on or abutting) the first end stop 75 of the guide slot portion 74. Additionally, the first detent 81 extends into the indent 104 on the outer portion 102 of the raised projection, thereby generally precluding rotation absent a force sufficient to overcome this securement.

Thus, to move out of the collapsed orientation to the articulated orientation, the hook assembly 14 is rotated relative to the hanger body. Initially, the rotation directs the raised projection away from the first end stop and, with sufficient force, the first detent 81 is directed out of the indent 104 of the raised projection. Continued rotation directs the raised projection along the guide slot portion toward the second end stop. Eventually, the raised projection reaches the second end stop which precludes further rotative movement, in addition, with sufficient force, the second detent is directed into the indent of the raised projection effectively, releasably maintaining the hook assembly in this second fully articulated configuration. It will be understood that additional structures may be positioned along the outer rim or within the channel 28 so as to allow for releasably locked positions between the collapsed orientation and the fully articulated configuration. To return the hook assembly back to the collapsed orientation, the process is repeated in reverse.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A hanger comprising:

a hanger body having a first face and a second face opposite the first face, and extending from a first end to a second end;

a hook assembly including a body with an outward side and an inward side opposite the outward side, and, a hook member extending from the body and terminating at an end tip; and an attachment assembly structurally configured to couple the hook assembly to the hanger body while facilitating relative rotation thereof, the attachment assembly comprising:

a first coupling component extending from one of the hanger body and the hook assembly, the first coupling component including a central post having an outer surface and locking tabs at a distal end thereof; and a second coupling component associated with the other of the hanger body and the hook assembly from the first coupling component, the second coupling component having a central bore with a rear annular surface, wherein, the central post extends through the central bore, with the locking tabs interfacing with the rear annular surface so as to substantially preclude axial movement of the central post within the central bore, while allowing rotation about an axis that extends through the central post;

wherein the second coupling component further includes a first side outer ring extending about the central bore, and a raised projection extending outwardly from the first side outer ring; and wherein the first coupling component further includes a guide slot portion having a first end stop and a second end stop, wherein the raised projection extends into the guide slot portion, and is positionable therealong between the first end stop and the second end stop, whereupon positioning of the raised projection at the first end stop defines the collapsed orientation of the hook assembly relative to the hanger body and the second end stop defines the articulated orientation of the hook assembly relative to the hanger body.

2. The hanger of claim 1 wherein the first coupling component further includes a first detent associated positioned proximate the first end stop and a second detent positioned proximate the second end stop, with the raised projection further including an indent configured to structurally engage the first end stop when in a collapsed orientation and the second end stop when in an articulated orientation to releasably lock the hook assembly relative to the hanger assembly to, in turn, preclude relative rotation therebetween.

3. The hanger of claim 1 wherein the guide slot portion comprises an arcuate member spaced apart from the central post.

4. The hanger of claim 3 wherein the guide slot comprises an arcuate member having a center of curvature that is concentric with the central post.

5. The hanger of claim 3 wherein the first coupling component includes an outer rim axially spaced apart from the central post, with the guide slot portion being defined by an inner surface thereof, and with the first end stop and the second end stop extending axially inward therefrom, with a channel defined between the central post and the outer rim.

6. The hanger of claim 1 wherein the first coupling component is associated with the hook assembly and the second coupling component is associated with the hanger body.

7. The hanger of claim 6 wherein the central post extends from the inward side of the body of the hook assembly.

8. The hanger of claim 7 wherein the central post is perpendicular to the inward side of the body.

9. The hanger of claim 1 wherein the body of the hook assembly further includes an upper boss portion, the upper boss portion having indicia corresponding to a size of a garment coupled to the hanger.

10. The hanger of claim 1 wherein the central bore includes a rounded first end structurally configured to urge the central post into position to extend therethrough.

11. The hanger of claim 1 wherein the body and the hook member are integrally molded.

12. The hanger of claim 1 wherein the body and the hook member comprise different materials.

13. The hanger of claim 1 wherein the central bore is substantially circular in cross section and the outer surface has a substantially circular cross sectional configuration that substantially corresponds to the central bore.

14. A hanger comprising:

a hanger body having a first face and a second face opposite the first face, and extending from a first end to a second end;

a hook assembly including a body with an outward side and an inward side opposite the outward side, and, a hook member extending from the body and terminating at an end tip; and an attachment assembly structurally configured to couple the hook assembly to the hanger body while facilitating relative rotation thereof, the attachment assembly comprising:

a first coupling component extending from one of the hanger body and the hook assembly, the first coupling component including a central post having an outer surface and locking tabs at a distal end thereof; and a second coupling component associated with the other of the hanger body and the hook assembly from the first coupling component, the second coupling component having a central bore with a rear annular surface, wherein, the central post extends through the central bore, with the locking tabs interfacing with the rear annular surface so as to substantially preclude axial movement of the central post within the central bore, while allowing rotation about an axis that extends through the central post; and wherein the central post further comprises opposing fixed portions with a beam spanning therebetween, each of the opposing fixed portions defining a portion of the outer surface, and, opposing flexible posts extending between the opposing fixed portions, with the locking tabs extending from distal ends of the opposing flexible posts, the flexible posts defining a portion of the outer surface.

15. The hanger of claim 14 wherein the opposing fixed portions and the beam spanning therebetween define an I-beam with opposing cavities, with the cavities being positioned proximate the opposing flexible posts, to in turn, allow for inward flexion of the opposing flexible posts into the opposing cavities.

16. A hanger comprising:

a hanger body having a first face and a second face opposite the first face, and extending from a first end to a second end;

a hook assembly including a body with an outward side and an inward side opposite the outward side, and, a hook member extending from the body and terminating at an end tip; and an attachment assembly structurally configured to couple the hook assembly to the hanger body while facilitating relative rotation thereof, the attachment assembly comprising:

a first coupling component extending from one of the hanger body and the hook assembly, the first coupling component including a central post having an outer surface and locking tabs at a distal end thereof; and a second coupling component associated with the other of the hanger body and the hook assembly from the first coupling component, the second coupling component having a central bore with a rear annular surface, wherein, the central post extends through the central bore, with the locking tabs interfacing with the rear annular surface so as to substantially preclude axial movement of the central post within the central bore, while allowing rotation about an axis that extends through the central post;

wherein the second coupling component further comprises a second side barrier portion positioned axially spaced apart from the rear annular surface of the central bore, the second side barrier portion defining a cavity, with the locking tabs being maintained within the cavity.

* * * * *